United States Patent [19]

Larsson

[11] Patent Number: 4,697,388

[45] Date of Patent: Oct. 6, 1987

[54] ARRANGEMENT FOR GRINDING PLANAR ANNULAR SURFACES

[75] Inventor: Lars-Inge Larsson, Ljungsbro, Sweden

[73] Assignee: Lars-Inge Larsson med Firma Larssons Industrimekaniska Verkstad, Ljungsbro, Sweden

[21] Appl. No.: 833,387

[22] PCT Filed: May 3, 1985

[86] PCT No.: PCT/SE85/00192

§ 371 Date: Jan. 8, 1986

§ 102(e) Date: Jan. 8, 1986

[87] PCT Pub. No.: WO85/05311

PCT Pub. Date: Dec. 5, 1985

[30] Foreign Application Priority Data

May 21, 1984 [SE] Sweden ..... 8402719

[51] Int. Cl.[4] ..... B24B 7/00

[52] U.S. Cl. ..... 51/120; 51/241 A

[58] Field of Search ..... 51/241 VS, 241 A, 90, 51/120, 209 R, 241 R, 119, 241 B

[56] References Cited

U.S. PATENT DOCUMENTS

| | | | |
|---|---|---|---|
| 771,194 | 9/1904 | Williams | 51/241 ES |
| 2,023,572 | 12/1935 | Brendel | 51/90 |
| 2,649,669 | 8/1953 | Tobis | 51/241 A |
| 2,674,069 | 4/1954 | Bauer | 51/120 |

FOREIGN PATENT DOCUMENTS

| | | |
|---|---|---|
| 468719 | 11/1928 | Fed. Rep. of Germany . |
| 83461 | 3/1935 | Sweden . |

*Primary Examiner*—Frederick R. Schmidt
*Assistant Examiner*—Maurina Rachuba
*Attorney, Agent, or Firm*—Jeffers, Hoffman & Niewyk

[57] ABSTRACT

The present invention relates to an arrangement for grinding planar annular surfaces (6; 8), especially the sealing surfaces of a valve. The arrangement comprises a hub (15) disposed rotationally fixed and bearing a planetary disc (16) mounted rotatably on the hub (15) and bearing in turn around its periphery a plurality of grinding heads (17) each having a grinding disc (19) mounted rotatably in its respective grinding head (17). The planetary disc (16) is effectively connected to a drive shaft (4) by means of which it can be caused to rotate relative to the hub (15). Between the hub (15) and the grinding discs (19) there are effective connections (31, 32, 33, 34, 35, 36) adapted to cause the grinding discs (19) to rotate relative to their respective ginding heads (17) when the planetary disc (16) is rotated relative to the hub (15). It is characteristic of the invention that the drive shaft (4) is mounted in the center of the hub (15) in such a way that it can be pivoted through approximately 180° in a plane normal to the planetary disc (16). This enables the grinding discs (19) to coincide with the planar annular surfaces automatically and irrespective of the inclination of the drive shaft (4) relative to the said planar annular surfaces.

3 Claims, 5 Drawing Figures

ARRANGEMENT FOR GRINDING PLANAR ANNULAR SURFACES

The present invention relates to an arrangement for grinding planar annular surfaces, especially the sealing surfaces of a valve, comprising a hub disposed rotationally fixed and bearing a planetary disc mounted rotatably on the hub and bearing in turn around its periphery a plurality of grinding heads each having a grinding disc mounted rotatably on its respective grinding head, this planetary disc being effectively connected to a drive shaft by means of which the planetary disc can be caused to rotate relative to the hub, and wherein there are effective connections between the hub and the grinding discs, adapted to cause the grinding discs to rotate relative to their respective grinding heads when the planetary disc is rotated relative to the hub.

Grinding arrangements of this type are used in particular for the final grinding of the sealing surfaces of valves. In the two main types of valve which exist, namely, shut-off valves and slide valves, the said surfaces are broadly speaking at right angles to the longitudinal extent of the valve spindle, or form a small angle with it. This has meant that for the final grinding of these two kinds of valve two different kinds of grinding arrangement have been required, which is naturally expensive and impractical, particularly as the final grinding is usually carried out on site by special assembly personnel.

A primary object of the present invention is to provide a grinding arrangement of the kind named in the introduction which is for general use, at least for the most usual kinds of valve, and this is made possible due to the fact that the drive shaft is mounted in the centre of the hub in such a way that it can be pivoted through approximately 180° in a plane normal to the planetary disc, thus enabling the grinding discs to coincide with the planar annular surfaces automatically and irrespective of the inclination of the drive shaft relative to the said planar annular surfaces.

The invention will be described in more detail in the following with reference to the accompanying drawing on which FIGS. 1*a* and 1*b* show a grinding arrangement according to the invention being used for the final grinding of sealing surfaces on a slide valve and on a shutoff valve, respectively.

Figure 1B:
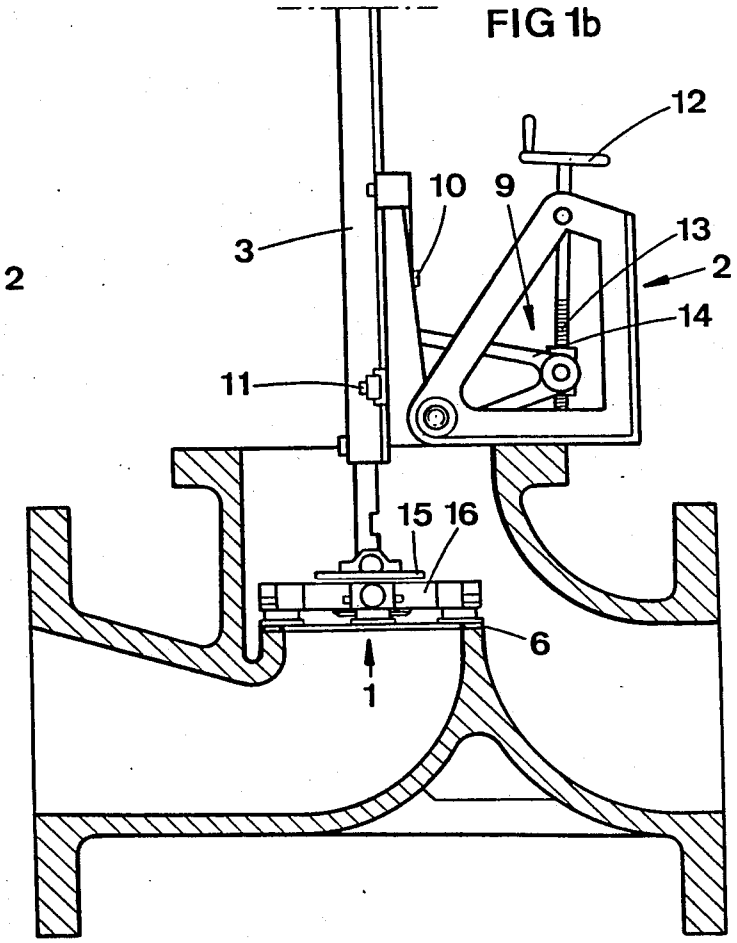
Figure 1A:
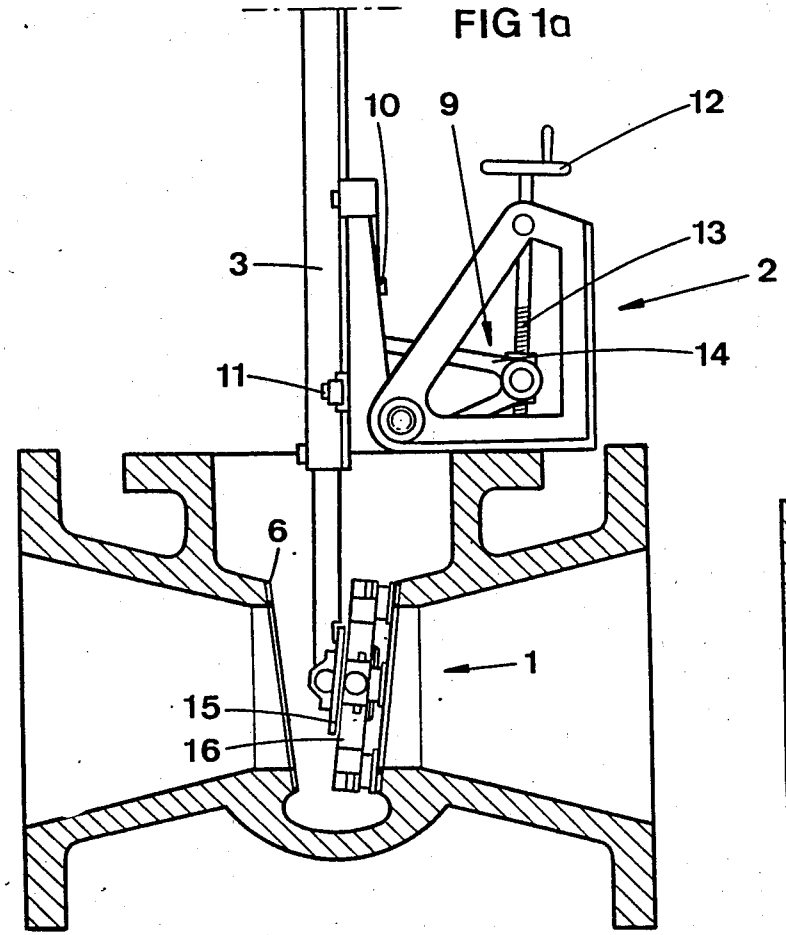
Figure 2:
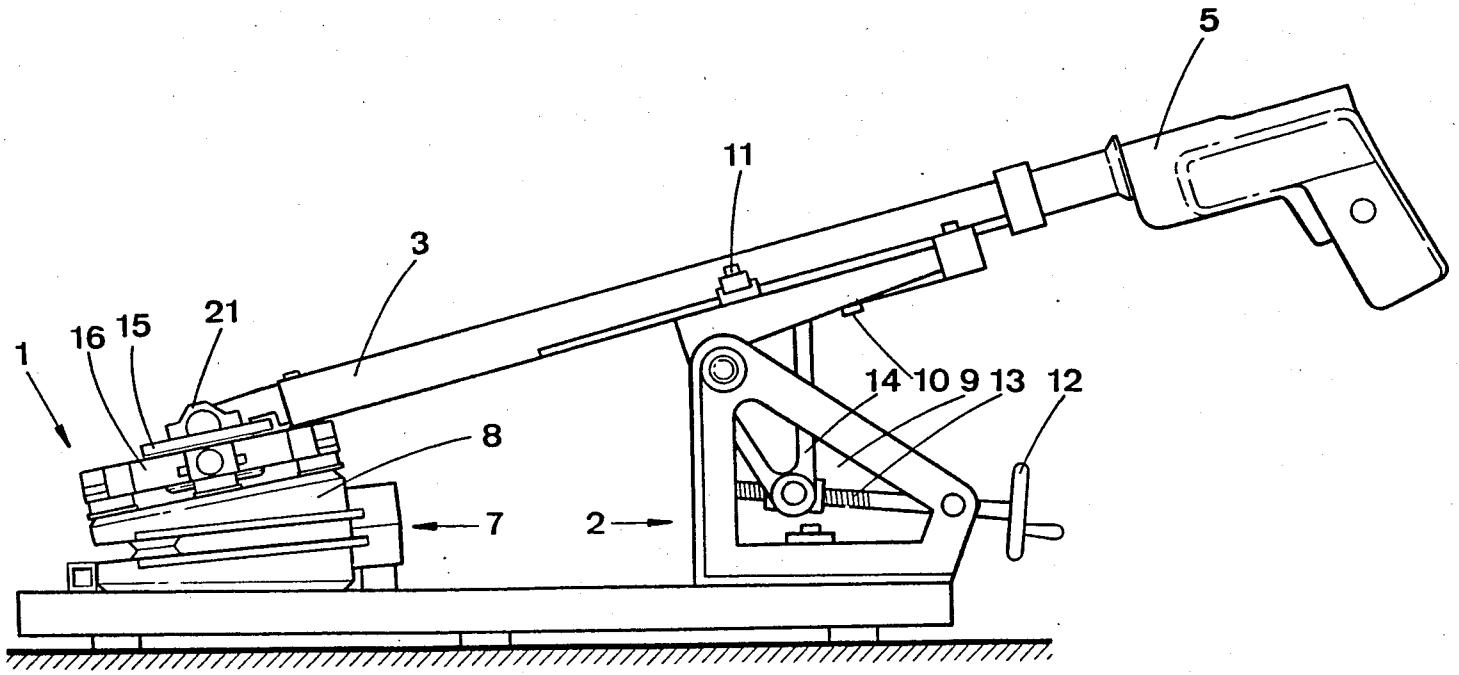
FIG. 2 is a side view showing an embodiment of a grinding arrangement according to the invention during the grinding of the sliding component of a valve.

In FIGS. 1 and 2 on the drawing, 1 is the designation of a grinding arrangement according to the invention which is mounted on a framework 2 via a tubular element 3 in which the drive shaft 4 of the grinding arrangement is rotatably mounted. This shaft may be driven by means of a hand-drill tool 5, operated by electricity or compressed air, which can be effectively connected to the outer end of the drive shaft 4. Via the framework 2 the grinding arrangement can be mounted on a valve housing 6 for the final grinding of the valve seat 6, FIGS. 1*a* and 1*b*, or on a cone cradle 7 for the final grinding of the cone or sliding component 8 of the valve, FIG. 2. The purpose of the cone cradle 7 is to serve as a support for the sliding component 8 of the valve and for the framework 2. The latter comprises a mechanism 9 for centering and adjusting the depth of the grinding arrangement, together with stop devices 10 and 11 respectively for the centering and depth-adjustment. The setting of the appropriate grinding pressure is effected by means of a wheel 12 and a spindle 13 with a thread on it, and a pushing and pulling spring 14.

The grinding arrangement comprises a hub 15 which bears a planetary disc 16 mounted so that it can rotate on the hub. Around its periphery the disc has a plurality of grinding heads 17; in the embodiment shown on the drawing the number of grinding heads is five. Each grinding head 17 comprises a part 18 which is mounted so that it may slide radially in the planetary disc 16, and a grinding disc 19 mounted rotatably on this part. The planetary disc 16 is effectively connected to the drive shaft 4 by means of which the planetary disc 16 can be caused to rotate relative to the hub 15.

According to the invention the mounting of the drive shaft 4 is positioned centrally on the hub 15 in such a way that the drive shaft can be pivoted through approximately 180° in a plane normal to the planetary disc 16. Furthermore, between the hub 15 and the grinding discs 19 there are effective connections adapted to cause the grinding discs 19 to rotate relative to their respective grinding head part 18 when the planetary disc 16 is rotated relative to the hub 15.

Figure 3:
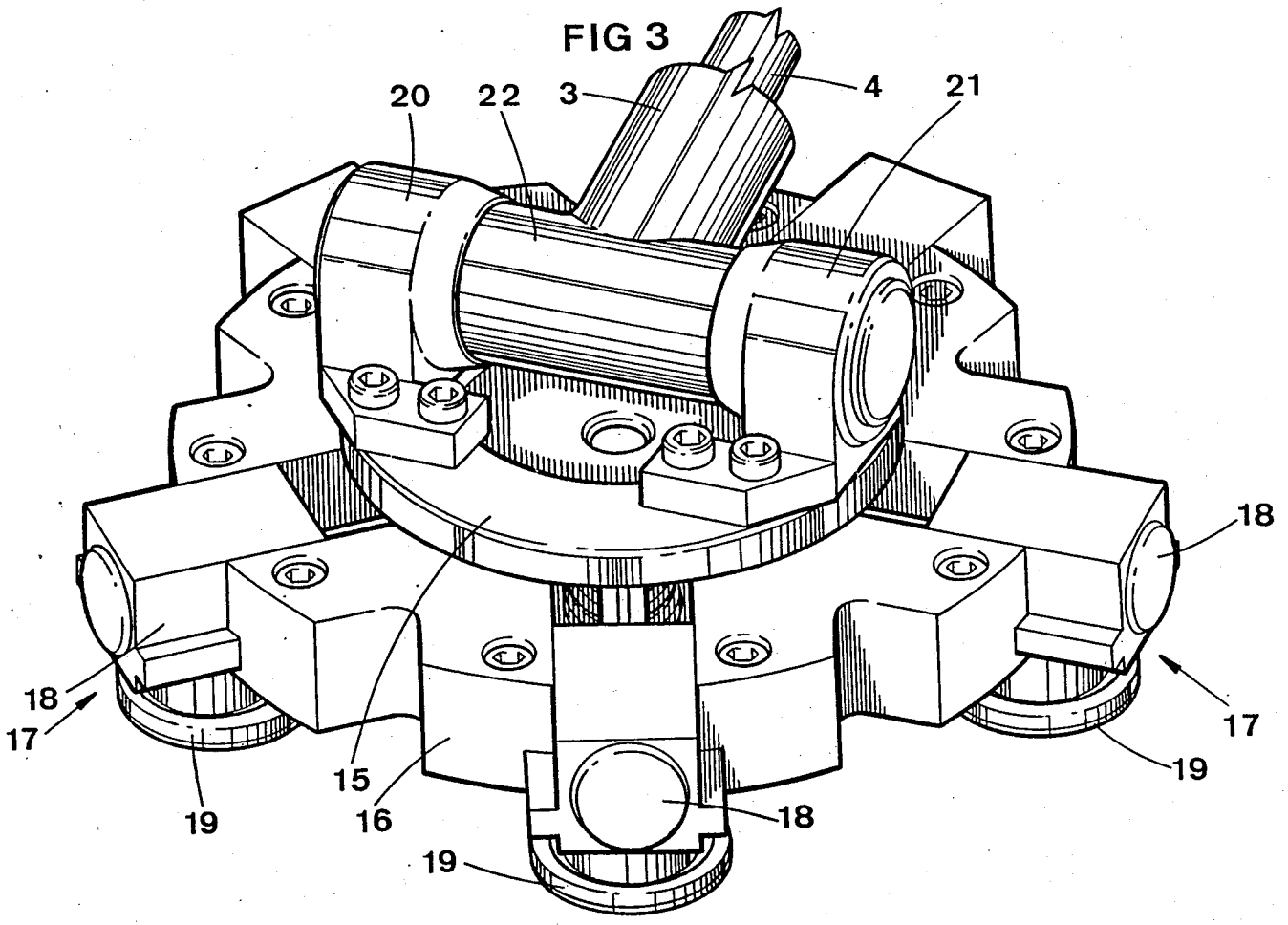
FIG. 3 is a detail showing the construction of the grinding arrangement shown in FIG. 2, in perspective and at an angle from above.
Figure 4:
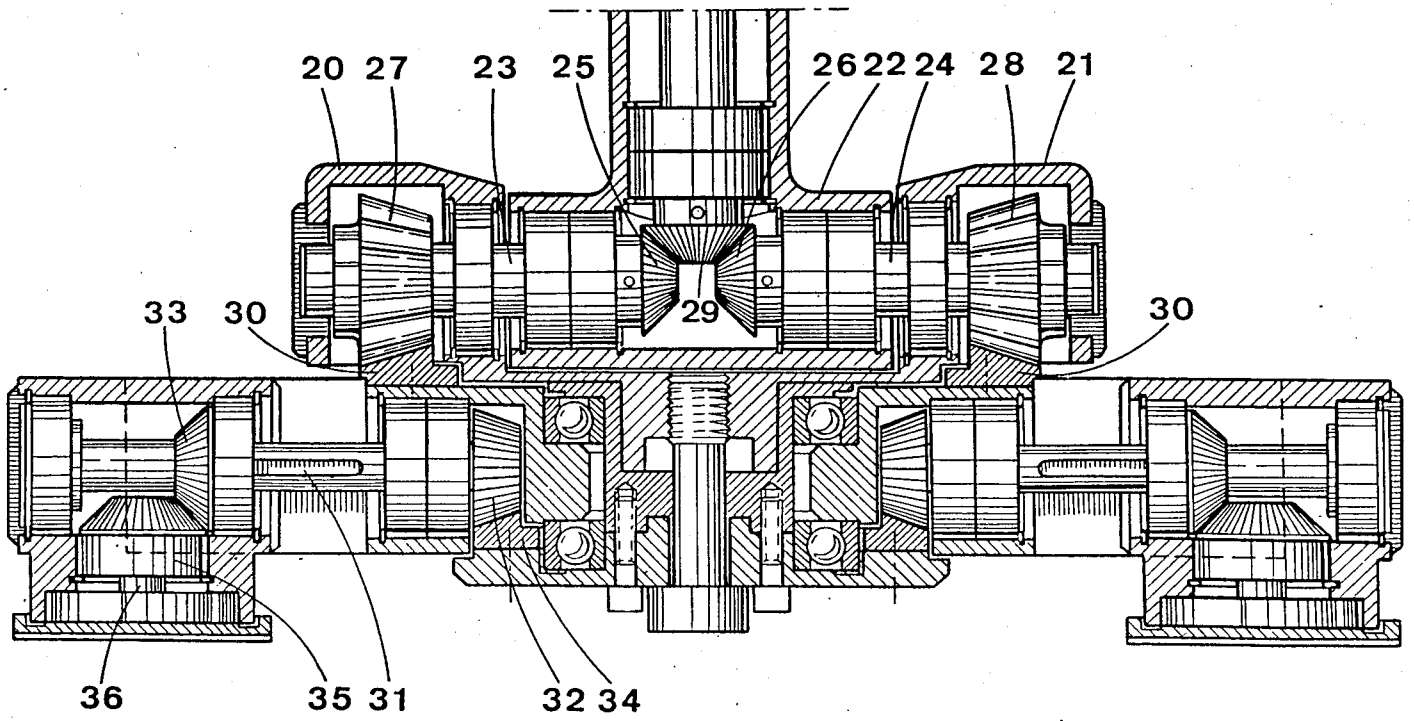
FIG. 4 is a cross-section through the grinding arrangement.

The manner in which the planetary disc 16 is effectively connected to the drive shaft 4, how the drive shaft 4 is mounted in the hub 15 and how the latter is effectively connected to the grinding discs 19 will now be described with reference in particular to FIGS. 3 and 4.

As can be seen in the said Figures, the hub 15 is equipped with two brackets 20, 21 in which a transverse part 22 on the tubular element 3 is mounted rotatably so that the said element 3 and with it the drive shaft 4 can be pivoted through approximately 180° in a plane normal to the planetary disc 16. The effective connection between the drive shaft 4 and the planetary disc 16, which is effective in every angular position within the said angle of 180°, consists of two shafts 23, 24 which are mounted rotatably in the transverse part 22, approximately parallel to the planetary disc 16. The ends of the shafts 23, 24 are equipped with conical gear wheels 25, 26, 27, 28, of which the opposing gear wheels 25, 26 engage with a conical gear wheel 29 on the drive shaft 4. The remaining gear wheels 27, 28 on the shafts 23, 24 respectively engage with a conical gear ring 30 disposed concentrically on the planetary disc 16. The rotation of the planetary disc 16 relative to the hub 15 when the shaft 4 is rotated is achieved by means of this effective connection.

In order to achieve the rotation of the grinding discs when the planetary disc 16 is rotated relative to the hub 15 an effective connection is required between the latter and the respective grinding discs 19. For each of the respective grinding discs 19 this consists of a spindle 31 mounted rotatably in the planetary disc and lying in a plane which is approximately parallel with that in which the intermediate shafts 23, 24 lie. The spindle 31 is equipped with two conical gear wheels 32, 33, one 32 of which engages with a conical gear ring 34 disposed concentrically on the hub 15. The other gear wheel 33 engages with a conical gear wheel 35 disposed at one end of a shaft 36 which is mounted rotatably in the part 18, and to the other end of which the grinding disc 19 is attached. The gear wheel 33 can be displaced along the spindle 31 in order to allow valves of different sizes to be ground.

By means of the above-described effective connections, when the drive shaft 4 is rotated the grinding discs 19 rotate around their shafts 36 and, due to the rotation of the planetary disc 16 relative to the hub 15, they also move in a circular path round the axis of rotation of the planetary disc 16. Very smooth sealing surfaces are obtained in this way. Moreover, the effective connection between the drive shaft 4 and the planetary disc 16 is constructed in such a way that it allows the grinding discs 19 to be angled relative to the drive shaft 4 within an angular range of approximately 180°.

I claim:

1. An arrangement for grinding planar annular surfaces, especially the sealing surfaces of valves, comprising:

a rotationally fixed hub with a center;

a rotatable planetary disc with a periphery mounted on said hub;

a plurality of grinding heads generally mounted at said disc periphery;

a grinding disc rotatably mounted on each of said grinding heads;

a drive shaft with a conical gear mounted on said drive shaft;

an intermediate shaft rotatably mounted on said hub and operably connected to said planetary disc;

at least one intermediate shaft first conical gear attached to said intermediate shaft;

said drive shaft conical gear engaging said intermediate shaft first conical gear;

said intermediate shaft having a first shaft part and a second shaft part centrally disposed on said planetary disc along a common center line, which center line is approximately parallel with said planetary disc, each of said first shaft part and second shaft part provided with a second conical gear;

a conical gear ring concentrically disposed on said planetary disc and engaging each of said second conical gears;

said drive shaft operable to rotate said planetary disc;

effective connections connecting said hub and said grinding discs, which effective connections rotate each of said grinding discs relative to their respective grinding heads when said planetary disc is rotated relative to said hub;

said drive shaft mounted at said hub center and pivotable through an angle of approximately 180° in a plane normal to said planetary disc, thereby enabling said grinding discs to automatically align with said planar annular surfaces irrespective of the inclination of said drive shaft relative to said planar annular surfaces.

2. An arrangement as claimed in claim 1 wherein said planetary disc defines a plane and, each of said effective connections between said hub and each of said respective grinding discs includes a spindle with a spindle longitudinal axis, which spindle is generally in a plane approximately parallel to said planetary disc plane, a spindle-contacting-conical gear ring concentrically disposed on said hub, a spindle conical gear wheel attached to each of said spindles and engaging said spindle-contacting-conical gear ring to rotate said spindles, a first beveled gear mounted on, rotatable with and axially movable along each of said spindles, second beveled gears operably connected to each of said grinding discs, each of said first beveled gears contacting and operable to drive a second beveled gear and grinding disc, each of said grinding heads including a housing part; each of said first beveled gears and said second beveled gears operable with a grinding disc are mounted in a housing part, which grinding heads and housing parts are mounted in said hub, each of said housing parts with said first and second beveled gears and said connected grinding disc is non-rotational about said spindle and is axially and radially displaceable along said spindle to align said grinding discs in said planetary disc.

3. An arrangement for grinding planar annular surfaces, especially the sealing surfaces of valves, comprising:

a rotationally fixed hub with a center;

a rotatable planetary disc with a periphery, which disc is mounted on said hub;

a plurality of grinding heads generally mounted at said disc periphery;

a grinding disc rotatably mounted on each of said grinding head;

a drive shaft with a conical gear mounted on said drive shaft;

an intermediate shaft rotatably mounted on said hub and operably connected to said planetary disc;

said intermediate shaft having a first shaft part and a second shaft part centrally and coaxially disposed on said planetary disc along a common center line, which center line is approximately parallel with said planetary disc, an intermediate shaft first conical gear and a second conical gear mounted and operable on each of said first part and second shaft part;

said drive shaft conical gear engaging said intermediate shaft first conical gears;

a conical gear ring concentrically disposed on said planetary disc and engaging each of said second conical gears;

said drive shaft operable to rotate said planetary disc;

effective connections connecting said hub and said grinding discs, which effective connections rotate each of said grinding discs relative to their respective grinding heads when said planetary disc is rotated relative to said hub;

said drive shaft mounted at said hub center and pivotable through an angle of approximately 180° in a plane normal to said planetary disc, thereby enabling said grinding discs to automatically align with said planar annular surfaces irrespective of the inclination of said drive shaft relative to said planar annular surfaces.

* * * * *

UNITED STATES PATENT AND TRADEMARK OFFICE

CERTIFICATE OF CORRECTION

PATENT NO. : 4,697,388
DATED : October 6, 1987
INVENTOR(S) : Lars-Inge Larsson

It is certified that error appears in the above-identified patent and that said Letters Patent is hereby corrected as shown below:

Claim 3, Col. 4, line 41, insert --shaft-- before "part".

Signed and Sealed this

Fifth Day of January, 1988

*Attest:*

DONALD J. QUIGG

*Attesting Officer*

*Commissioner of Patents and Trademarks*